US009446281B2

(12) United States Patent
Abelbeck

(10) Patent No.: US 9,446,281 B2
(45) **Date of Patent: *Sep. 20, 2016**

(54) FUNCTIONAL EXERCISE DEVICE

(71) Applicant: Kevin Gene Abelbeck, Fort Collins, CO (US)

(72) Inventor: Kevin Gene Abelbeck, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/107,757

(22) Filed: Dec. 16, 2013

(65) Prior Publication Data

US 2014/0106942 A1 Apr. 17, 2014

Related U.S. Application Data

(63) Continuation-in-part of application No. 12/930,996, filed on Jan. 22, 2011, now Pat. No. 8,622,878.

(51) Int. Cl.

| | |
|---|---|
| ***A63B 21/00*** | (2006.01) |
| ***A63B 21/002*** | (2006.01) |
| ***A63B 21/062*** | (2006.01) |
| ***A63B 23/00*** | (2006.01) |
| ***A63B 21/06*** | (2006.01) |
| ***A63B 21/072*** | (2006.01) |
| ***A63B 23/12*** | (2006.01) |
| *A63B 23/035* | (2006.01) |

(52) U.S. Cl.

CPC ..... *A63B 21/0601* (2013.01); *A63B 21/0004* (2013.01); *A63B 21/0628* (2015.10); *A63B 21/0724* (2013.01); *A63B 21/0728* (2013.01); *A63B 21/4035* (2015.10); *A63B 23/12* (2013.01); *A63B 23/1209* (2013.01); *A63B 23/03525* (2013.01)

(58) Field of Classification Search

USPC ..... 482/93, 98, 100, 132, 134, 135–139, 482/148

See application file for complete search history.

(56) References Cited

U.S. PATENT DOCUMENTS

| | | | | |
|---|---|---|---|---|
| 5,397,154 | A | 3/1995 | Baldwin | |
| 5,679,105 | A * | 10/1997 | Vittone | A63B 21/072 482/110 |
| 6,679,815 | B2 * | 1/2004 | Vittone | A63B 21/06 482/106 |
| D606,611 | S | 12/2009 | Rogers et al. | |
| 7,727,089 | B2 | 6/2010 | Gilman | |
| 7,955,223 | B1 | 6/2011 | Gilman | |
| 7,972,224 | B2 | 7/2011 | Gilman | |
| 8,360,938 | B2 | 1/2013 | Gilman | |

* cited by examiner

*Primary Examiner* — Oren Ginsberg
*Assistant Examiner* — Shila Jalalzadeh Abyan

(57) ABSTRACT

An exercise device with a frame which may include a longitudinal center section, defining a first end and a second end, and two substantially equal end sections, one of each of the end sections may be coupled to the first end and the second end of the center section substantially at a midpoint with respect to the width and the height of the end sections. One or more pins may be coupled to the frame between the first end and the second end, the pins adapted to receive weight plates. A bumper may be coupled to the top and bottom of the end sections. A sled frame may be added to the device to convert the device to a functional sled with different configurations. The sled skids may be removable to be easily repositioned, removed or replaced when worn.

9 Claims, 11 Drawing Sheets

132

134

FUNCTIONAL EXERCISE DEVICE

CROSS-REFERENCE TO RELATED APPLICATION DATA

This application is a Continuation-in-Part of U.S. patent application Ser. No. 12/930,996, filed on Jan. 22, 2011, which is currently pending.

FIELD OF THE INVENTION

The present invention generally relates to exercise devices and, more particularly, to exercise devices which enable simulation of a functional activity and may be converted to an alternative training device.

BACKGROUND OF THE INVENTION

Exercise has been shown to have significant benefits to the general population as well as athletes of all types. The term Functional Training has started to become more popular recently. Functional Training may be referred to as "purposeful training", as it is not exercise for the sake of exercise, or exercise to build a bigger biceps muscle. Functional training is performing exercises to simulate an activity or motion used on the playing field or in life.

Endurance athletes have traditionally trained functionally. If they are runners, they run. If they are cyclists, they ride. Many athletes fall under the umbrella of strength and power. Throwing a discus, jumping and sprinting are better equated to power development than to strength as an optimal result is the work done over the shortest amount of time. A football lineman exploding off the line to meet his opponent relies on his power for optimal performance. Holding his position against the forces of the opponent uses his strength. An athlete's strength is important when it comes to slow movements under a great deal of resistance. Power is important when the movement is fast. It is easy to see that both strength and power are important in many physical events.

Functional training in strength and power has only started to gain popularity. Functional strength training in a gym or weight room has previously been limited due to the lack of equipment available to simulate functional events. A barbell squat is very good for developing strength in the lower body extensor muscles of the user, but it is only functional if that athlete competes by lifting a bar placed on his back. For a power lifter, it is functional, as this type of lifting is how that athlete competes. For the football lineman, a squat may be a good supplementary exercise to build strength, but the conditions on the field are far from replicated in a squat rack. On the field, the athlete will move and step. Under load they may be momentarily balanced on one foot. Load may be applied to the hands and supported by the feet on the ground, thus the arms to the torso to the legs are all under stress. Little, if any, gym based exercise equipment truly prepares the athlete for these conditions.

One item currently used by strength and conditioning professionals is an old truck tire. The tire may be laid flat on the ground or turf. The user approaches the tire, puts their hands under the lower edge of the tire and then lifts the tire to vertical and pushes it over. Though this presents a very functional movement, the tire has several limitations as a form of resistance. First, the weight cannot be changed to accommodate different users or progressive resistance as an athlete increases in strength and power. The diameter and thickness (height) are different for many tires and are therefore inconsistent from one program to the next. New tires can cost tens of thousands of dollars and are therefore, not practical. The usual process is to buy tires before they are recycled. This presents a "this is what is available, take it or leave it" situation for the strength coach and his athletes. In addition, a 700 pound tire cannot be broken down to a 200 pound frame, that may be more easily moved and stored, and 500 pounds of weight plates that can be used elsewhere. The tire was designed to be a tire and not a piece of exercise equipment, so there are other natural limitations such as the lack of proper handles. Also, worn tires often have exposed steel belts that can rub against the athlete's arms, resulting in injury to the athlete and limiting the weight they can lift due to an inability to hold on to the tire. A tire also requires a supinated grip, which predisposes the athlete to distal biceps tendon stress. Many a strength athlete wears the scar of a biceps tendon surgery as a result of the combination of a very high load and a supinated grip. A similar lift only using a pronated grip rarely if ever results in damage to the tendons in the elbow.

Another clear advantage of any product, and exercise equipment is not unique, is the ability to easily convert any device to perform a different function. The ability to add or remove sled skids on a piece of functional training equipment allows additional function at minimal cost, because much of the structure of the original equipment is used for both purposes. With budget limitations and equipment purchases being more competitive, multiple function capability of any piece of equipment may be desired.

It should, therefore, be appreciated that there is a need for a functional training device that allows for altering resistance for different users, as well as enables progressive training as the user increases in strength and power development. The present invention fulfills this need and others.

SUMMARY OF THE INVENTION

The present invention may include a frame with a longitudinal center section, defining a first end and a second end, and two substantially equal end sections. One of each of the end sections may be coupled to the first end and the second end of the center section, substantially at a midpoint with respect to the width and the height of the end sections. The frame may also include a pin adapted to receive a weight plate, which may be coupled to the center section, between the first end and the second end. A bumper may be coupled to a top and a bottom of each of the end sections, whereby the device may be supported by two of the bumpers and flipped over to be supported by the other two bumpers.

The frame may be substantially symmetrical about three orthogonal planes intersecting at a geometric center of the frame. The bumper may be a substantially longitudinal member with a hollow cavity. A bumper plate may be inserted into the hollow cavity of the substantially longitudinal bumper. The bumper plate may include fasteners enabling fastening to the end sections, whereby a bumper located between the end section and the bumper plate may be thereby coupled to the end section by the bumper plate. The bumper plate may be substantially longitudinal and include a flange along a long side of the bumper plate or along both long sides of the bumper plate.

The invention may further include a handle coupled to each of the two substantially equal end sections of the frame. The invention may also include a chest support coupled to each of the two substantially equal end sections of the frame. The chest support may also be coupled directly to one bumper.

The invention may also include a sled frame with a frame receiver. The frame receiver may include a first end and a second end, and a frame support adapted to fasten the frame receiver to a mounting plate. A sled skid may be included, which may include a skid extension adapted to be releasably coupled to the first end or the second end of the frame receiver. The sled skid may also include a skid base with a first end and a second end. The skid base may be mounted to the skid extension. A skid rail may be mounted to the skid base and may include an arcuate portion. A skid rib may be coupled to the skid base and the skid rail at a position between the first end and the second end of the skid base.

A handle may be included, with a handle extension adapted to be releasably coupled to the first end or the second end of the frame receiver. The handle may further include a handle bar mounted to the handle extension.

The sled frame may include a first lock coupled to the first end of the frame receiver and a second lock coupled to the second end of the frame receiver. The first lock and the second lock may each include a lock pin adapted to be received by a pin receiver in the skid extension of the sled skid. The pin receiver on the skid extension of the sled skid may be in the shape of an elongated slot, whereby the pin may be received in the elongated slot and the skid may still move with respect to the lock, within the limits of the elongated slot. The pin receiver may be located in two opposing sides of the skid extension, thereby providing a pin receiver on either side of the sled skid. The first lock and the second lock may each be comprised of a spring biased pin.

The sled frame may include a first frame receiver and a second frame receiver and a frame cross bar connecting the first frame receiver to the second frame receiver. The frame cross bar may be positioned nearer to the first end of the first frame receiver and the first end of the second frame receiver than it is to the second end of the first frame receiver and the second frame receiver.

A bushing may be provided near the first end and the second end of each of the first frame receiver and the second frame receiver. The bushing may include a double flange to aid in securing the bushing to the first frame receiver and the second frame receiver. The bushing may be adapted to receive the skid extension of the sled skid and the handle extension of the handle.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
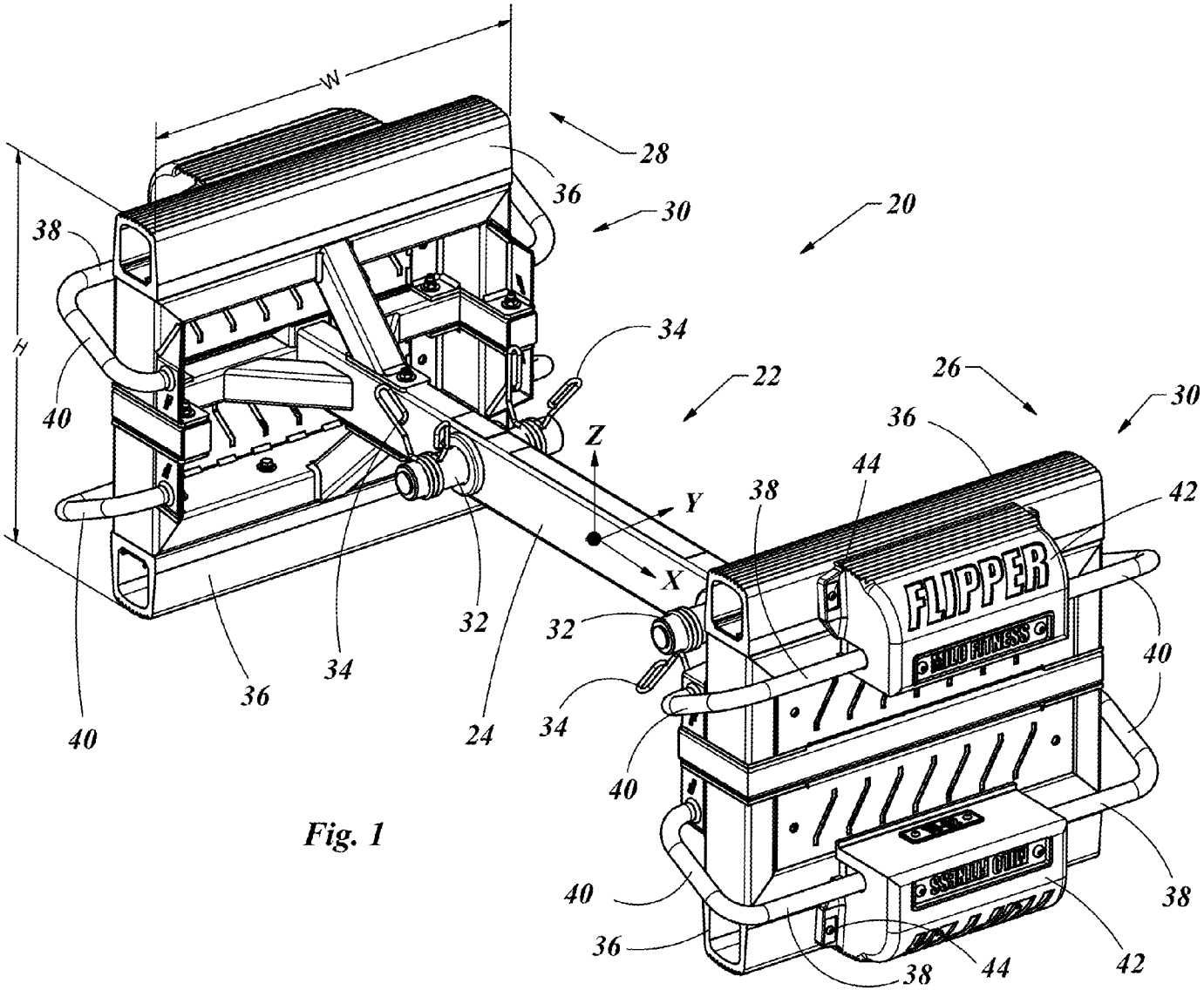
FIG. 1 is an isometric view of an exercise device enabling functional exercise with a varied resistance, in accordance with the present invention.
Figure 2:
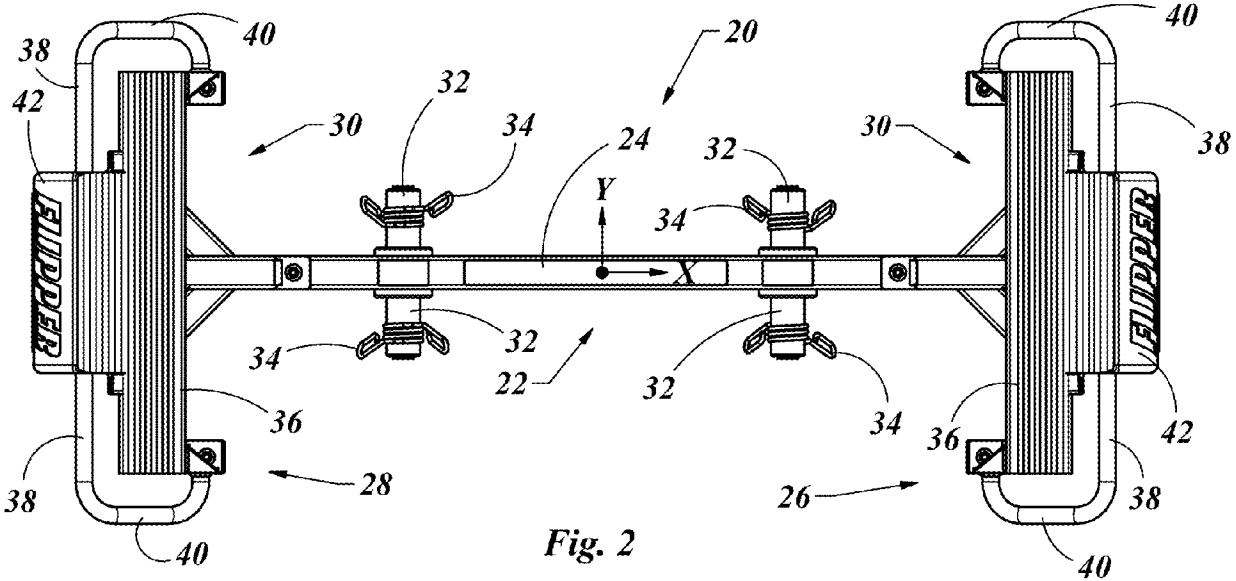
FIG. 2 is a top view of the exercise device shown in FIG. 1.
Figure 3:
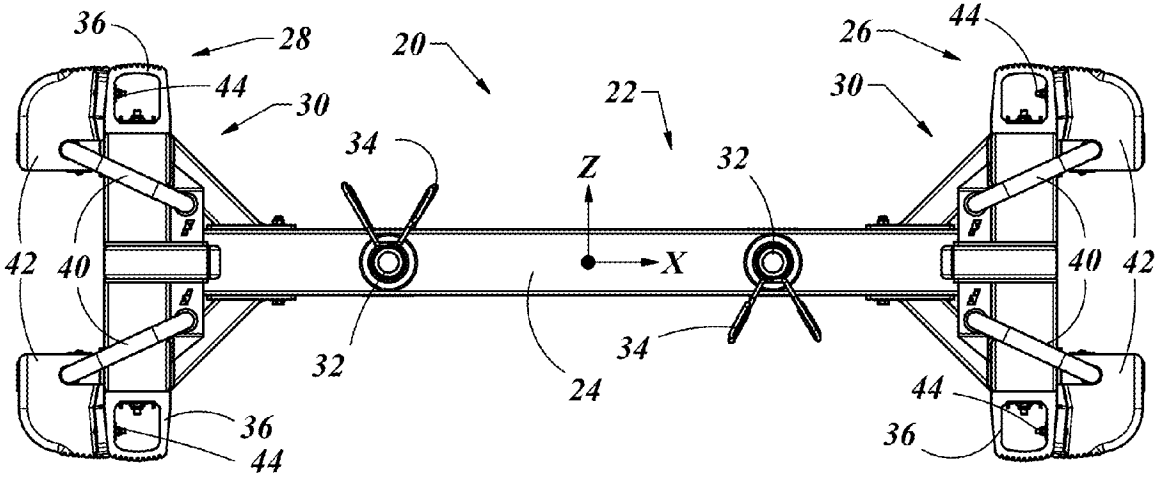
FIG. 3 is a front view of the exercise device shown in FIG. 1.

With reference to the illustrative drawings, and particularly to FIGS. 1-3, there is shown a functional exercise device 20. The device 20 may include a frame 22, comprising a longitudinal center section 24. This longitudinal center section 24 may include a first end 26 and a second end 28. Two substantially equal end sections 30 may be positioned one on the first end 26 and a second on the second end 28 of the longitudinal center section 24. The two substantially equal end sections 30 may be coupled to the respective ends of the longitudinal center section 24 and a midpoint with respect to the width (W) and height (H) of the end sections 30.

A pin 32 may be coupled to the center section 24 between the first end 26 and the second end 28. The pin 32 may be adapted to receive and support a weight plate. In this embodiment, two pins 32 are positioned along the longitudinal center section 24 of the frame 22, and extend outwardly in both directions from the longitudinal center section 24. This would allow a weight plate to be placed on any one of four different positions on the device 20. Spring collars 34 may be releasably coupled to the pins 32 to secure a weight plate on the pin 32 of the device 20. The spring collars 34 are illustrated in one of many forms that these may take in that pressing the handles together increases the diameter of the coil allowing the spring collar 34 to be placed on the pin 32 or removed from the pin 32. The natural position of the spring collar 34 is such that it tightens down onto the pin 32, holding it in place with respect to the device 20.

A bumper 36 may be coupled to the top and bottom of each end section 30. As is shown in FIG. 1, the device 20 may rest on the bottom bumpers 36 or flipped over to rest on what are now the top bumpers 36. Regardless of the orientation, the device 20 will present itself to the user in a uniform manner, regardless of its orientation as described, in that the device 20 is substantially symmetrical about all three orthogonal planes intersecting at a geometric center of the frame 22, as illustrated in the 3-dimensional axis coordinate system located about the center of the longitudinal center section 24. This is further illustrated in FIG. 2, which shows a top view of the device 20, and in FIG. 3, which shows a side view of the device. The 3-dimensional coordinate system is shown in FIGS. 1-3 as for illustrative purposes.

The device 20 may also include handle 38 coupled to each of the two substantially equal end sections 30 of the frame 22. In this embodiment, there is shown more than one set of handles 38. One handle 38 may be positioned above the other on the first end 26 and similarly on the second end 28 of the frame 22. The handles 38 may provide a functional structure in which to grasp and transfer power to the device 20 in order to lift that end and flip it over, thus performing the exercise. Spotter handles 40 may be located laterally from the handles 38. If desired, the spotter handles 40 may also be used by the lifter to lift and flip the device 20. In addition, the spotter handles 40 may be used by someone assisting the lifter as a safety feature, to help guide, assist, or take over for the lifter if the lifter experiences any problems during the lift.

A chest support 42 may be coupled to each of the two substantially equal end sections 30 of the frame 22. In this embodiment, the device 20 may include two chest supports 42 on the first end 26 and the second end 28. The two chest supports 42 may be vertically displaced one from the other and substantially equidistant from the midpoint of each end sections 30. In this embodiment, the chest supports 42 may also be coupled to the bumper 36 by way of the side bumper bolts 44. Coupling the chest supports 42 to the bumper 36 with the side bumper bolts 44 may help to mitigate the shear forces applied to the chest support 42 when the device 20 is being flipped. The shear forces tend to pull the chest support 42 away from the bumper 36 on the device 20. The side bumper bolts 44 may help keep the chest supports 42 in place.

Figure 4:
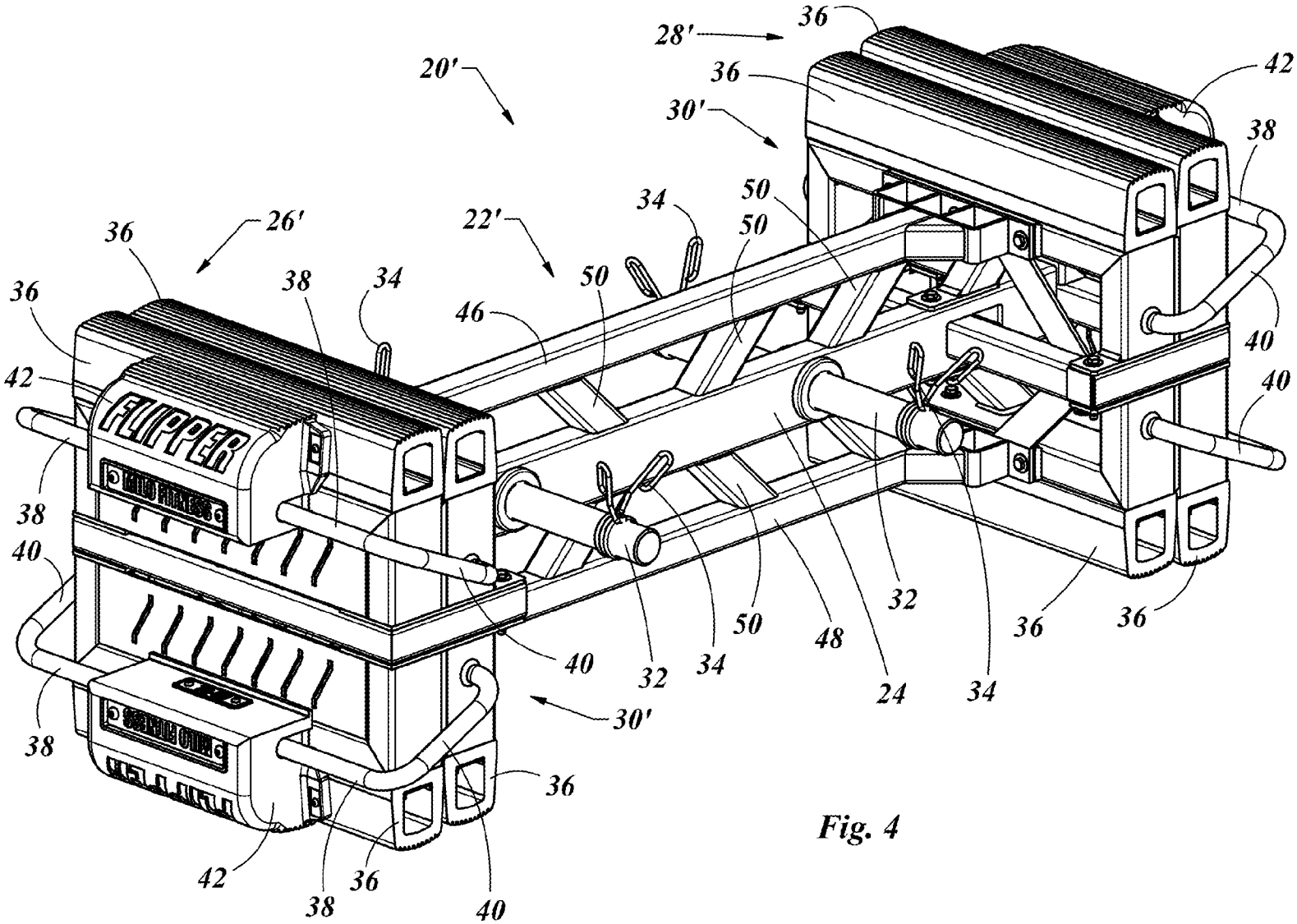
FIG. 4 is an isometric view of a variation to the exercise device of FIG. 1, which is adapted to handle additional weight and also includes additional bumpers.
Figure 5:
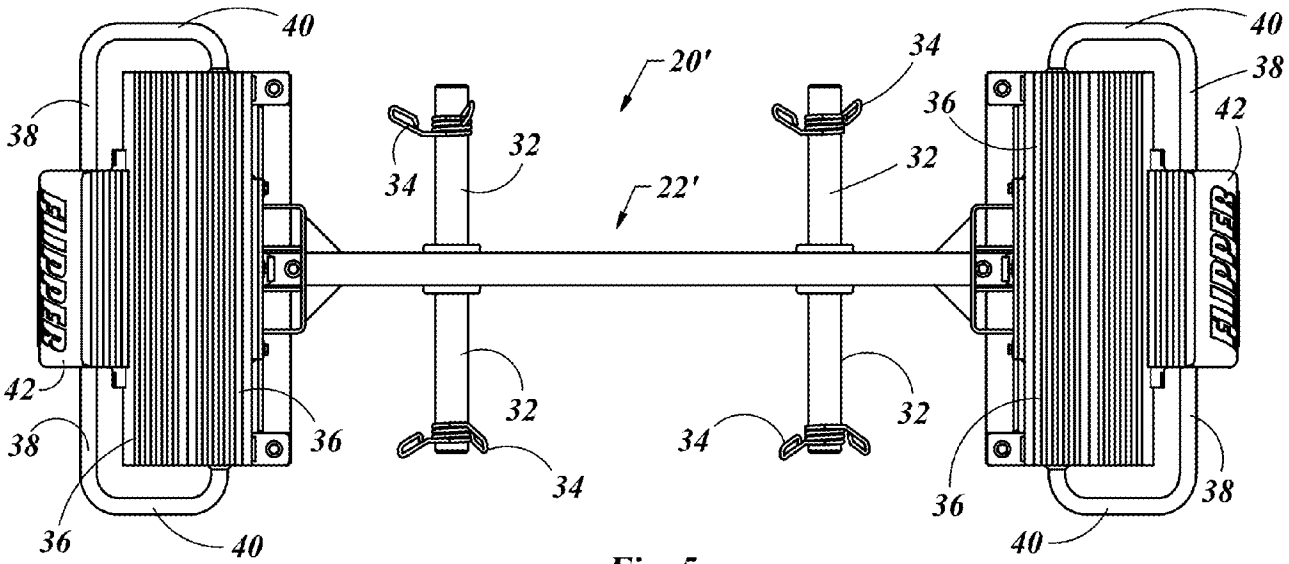
FIG. 5 is a top view of the exercise device of FIG. 4.
Figure 6:
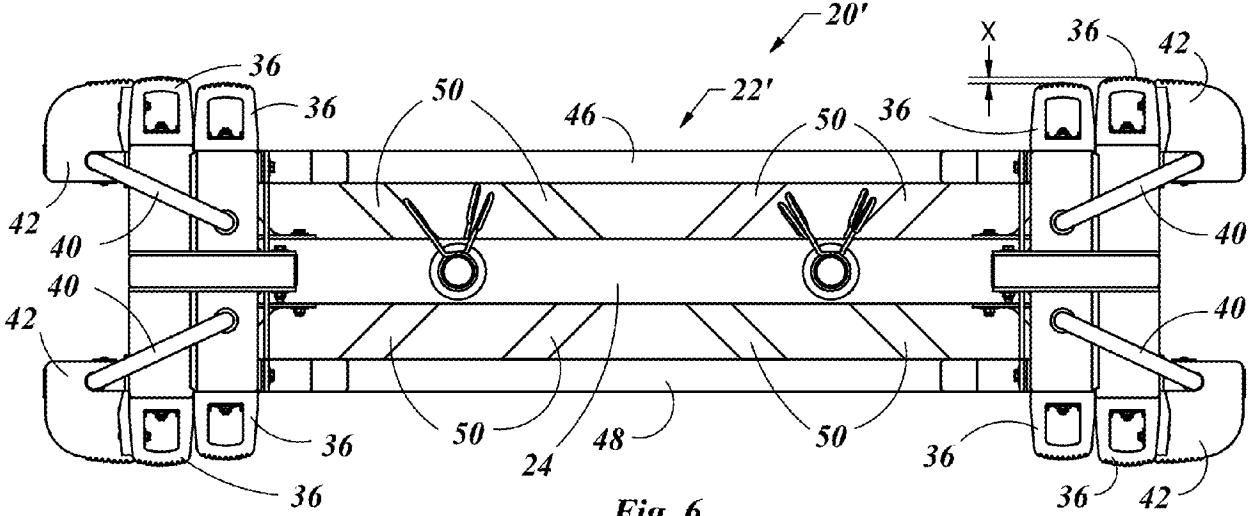
FIG. 6 is a front view of the exercise device of FIG. 4.

An alternative to this embodiment is shown in FIGS. 4-6. In this embodiment of the invention, the device 20' may include a slightly modified frame 22'. In addition, the end sections 30' of the first end 26' and the second end 28' may be adapted to handle additional weight. As is shown in FIG. 4 there may be two bumpers 36 on the top and the bottom of each end section 30'. The chest support 42, handles 38, including the spotter handles 40 may be similar to that as previously disclosed, and have substantially the same function.

The frame 22' may include a top rail 46 and bottom rail 48, which each may be supported to the longitudinal center section 24 by way of one or more support members 50. The combination of the top rail 46, the bottom rail 48, and the support members 50, mounted to the longitudinal center section 24 may increase the section modulus of the combination relative to the longitudinal center section 24 alone. The greater section modulus of the frame 22' allows for a greater load to be applied to the pins 32. With some basic structural modifications, such as this to the frame 22', a variety of devices 20' may be adapted for different conditions, thereby meeting the needs of the numerous populations of athletes. The lengths of the pins 32 may also be adjusted to accommodate greater or fewer weight plates. This can be seen in the lengths of the pins 32 in the device 20 shown in FIGS. 1-3 relative to the lengths of the pins 32 in the device 20' shown in FIGS. 4-6. Longer the pin 32, the greater number of weight plates may be received by the pin 32, and secured by the spring collar 34. The device 20' as shown in FIGS. 4-6 may be adapted to handle a greater load as compared to the device 20 shown in FIGS. 1-3. As such, the pins 32 in the heavier version of the device 20' may be longer than the pins 32 in the lighter version of the device 20.

As is shown in the embodiment in FIG. 6, it may be desirable to sequence the contact with the bumpers 36 against the supporting surface, such as the floor, turf field, or the ground. An advantage to stepping the contact of the bumpers 36 with the supporting surface may be to reduce the impulse transferred to the frame 22' when the bumpers 36 contact the ground when the device 20' is flipped over. The bumpers 36 may be produced of a rubber or other material with elastic properties. This will allow the bumper 36 to deform when the device 20' is flipped over and the bumpers 36 contact the ground. Allowing the bumpers 36 to deform increases the time over which the contact with the ground is made. This in turn, reduces the maximum force of the impulse. By stepping, or offsetting the height of the bumpers, as shown here by the dimension "X", the bumper 36 nearest the chest support 42 may make contact with the ground first, be deformed slightly, by the dimension "X" and then contact the adjacent bumper 36 farther away from the chest support 42, to then aid in dissipating the energy of the impact with the ground. This duel, stepped bumper 36 design, in combination may allow for the greater structural ability required with heavier loads, without potentially making an excessively rigid bumper 36. By simply doubling the bumpers 36 evenly and having them contact the ground simultaneously, the bumpers 36, in combination, may be too stiff, resulting in excessively high impact loads to the frame 22' when contacting the ground as a result of being flipped over.

Figures 7, 8:
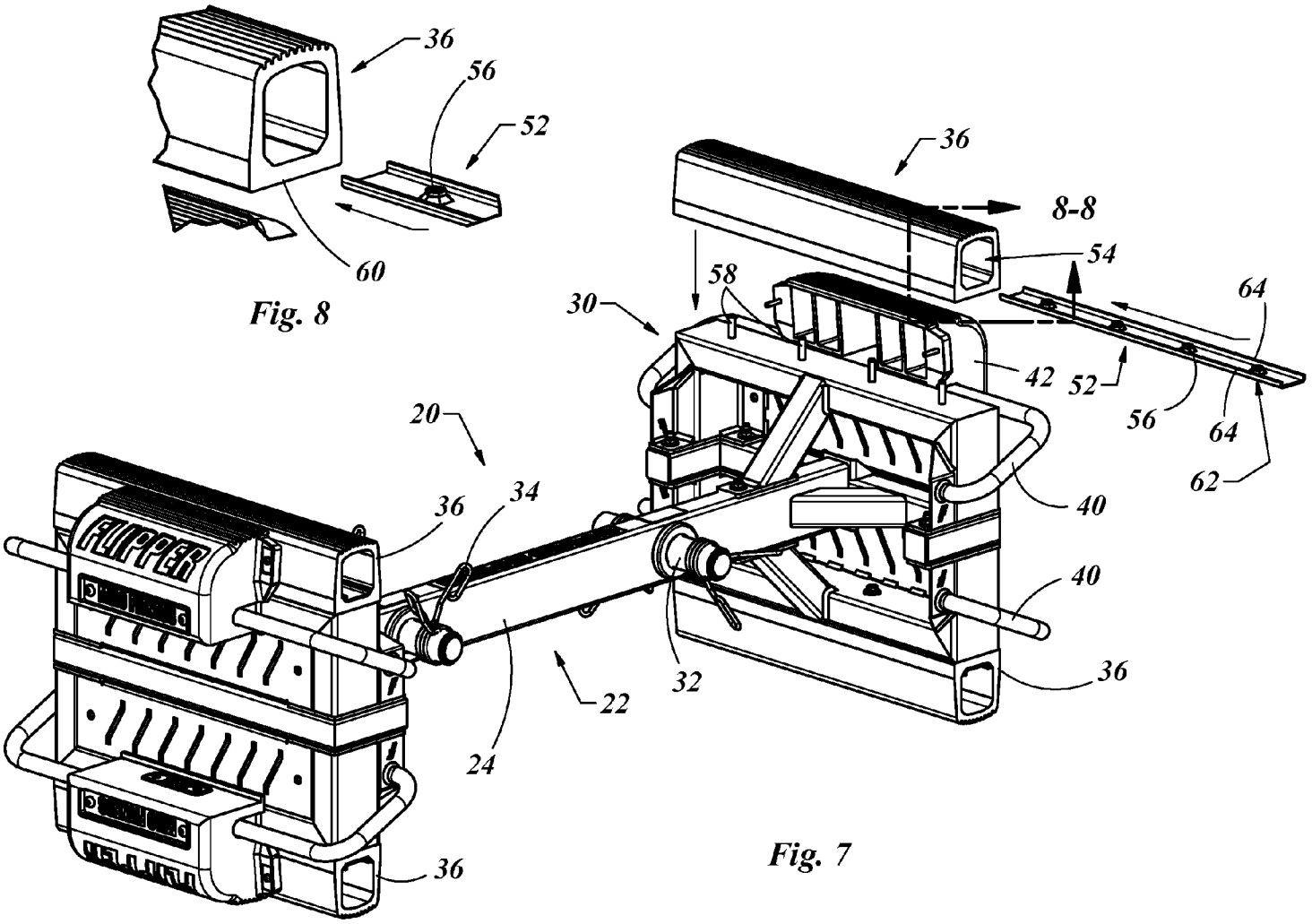
FIG. 7 is an isometric view of the exercise device of FIG. 1 with a bumper and pumper plate displaced.
FIG. 8 is a detail view of the displaced bumper and bumper plate of FIG. 7 shown along line 8-8.

With regard to FIGS. 7-8, the device 20 is shown with a bumper 36 displaced from the end section 30 of the frame 22. The detail of the bumper 36 and bumper plate 52 is shown in FIG. 8. As previously noted, the bumper 36 may be constructed of a material with elastic properties. In addition, the physical shape of the bumper 36 may also facilitate the controlled deceleration of the device 20 at impact of the device 20 with the ground. One way of enabling a controlled structural elastic deformation of the bumper 36 may be to make the bumper hollow, thus providing a hollow cavity 54 in the bumper 36. The presence of the hollow cavity 54 in the bumper 36 may also facilitate fastening the bumper 36 to the end section 30 of the frame 22. This may be done by providing a bumper plate 52, which may be received by the hollow cavity 54 of the bumper 36. The bumper plates 52 may include one or more fasteners 56, so that a bolt 58 received by the end section 30 of the frame 22 may pass through the bottom portion 60 of the bumper 36 and be received by the fastener 56, which may be part of the bumper plate 52.

When the device 20 is flipped over, and the bumper 36 contacts the ground, there may be forward momentum associated with the device 20 at the point of impact with the ground. This forward momentum, in a direction away from the lifter, may cause a shear force between the bumper 36 in the end section 30 of the frame 22. The bumper plates 52 may act as an extension of the frame 22 in that they may be fastened to the end section 30 of the frame 22. As such, the resistance to the shear force placed on the bumper 36 at the point of impact with the ground may be mitigated by the friction between the bottom portion 60 of the bumper 36 and the end section 30 of the frame 22 and a reaction force of an outer edge of a long side 62 of the bumper plate 52 against the inside of the bumper 36.

If a shear force that is applied to the bumper 36 is greater than the friction between the bumper 36 and the end section 30 of the frame 22, the resultant force required to keep the bottom portion 60 of the bumper 36 substantially stationary with respect to the end section 30 of the frame 22 will be the force applied by the long side 62 of the bumper plate 52 against the inside of the bumper 36. This resultant force will be applied by the long side 62 of the bumper plate 52 against an inside edge of the hollow cavity 54 of the bumper 36. If the bumper plate 52 is substantially flat, providing only the thickness of the material of the bumper plate 52 contacting the inside of the hollow cavity 54 of the bumper 36, a substantial pressure may be applied on a concentrated area along the inside of the hollow cavity 54 of the bumper 36.

It may be desirable to increase the contact area between the long side 62 of the bumper plates 52 and the inside edge of the hollow cavity 54 of the bumper 36. By increasing the surface area of contact between the bumper plate 52 and the bumper 36, the pressure in this area along the inside of the bumper 36 decreases proportionally with the increase in surface area. With that in mind, a flange 64 may be provided on one or both of the long sides 62 of the bumper plates 54. The force applied along the long side 62 of the bumper plate 52 against the inside of the bumper 36 may typically only be on one side of the bumper 36, so that may suggest only one flange 64 is needed. It may be desirable to put a flange 64 on both long sides 62 of the bumper plate 52 to increase the structural strength of the bumper plate 52 so that it has less of a tendency to deformed as a result of the tension provided by the bolts 58. Also, if the bumper plate 52 includes a flange 64 along both long sides 62, this eliminates a potential error in assembly where the bumper plate 52 could be assembled with the flange 64 on the wrong side relative to the bumper 36.

Figure 9:
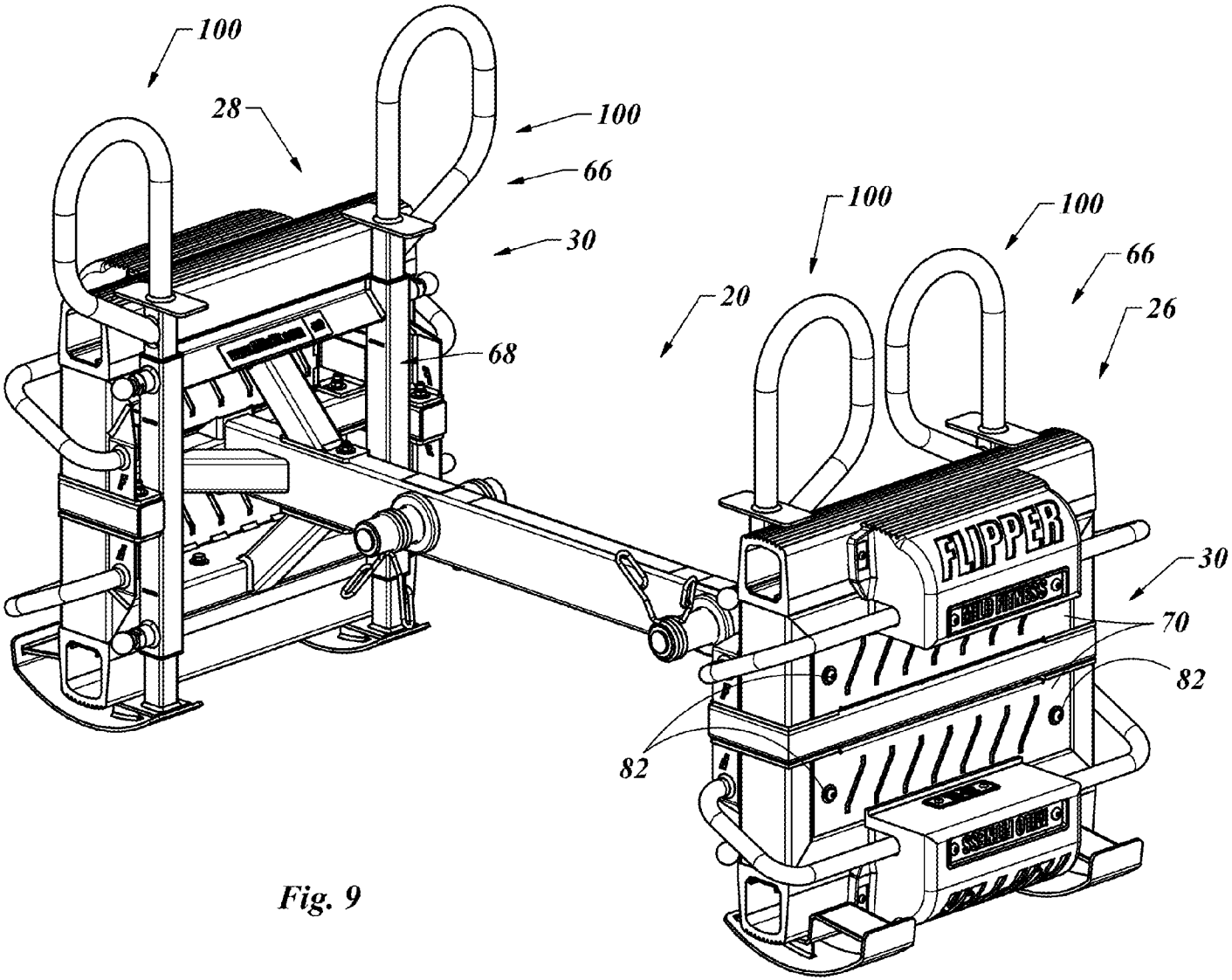
FIG. 9 is an isometric view of the exercise device of FIG. 1 with the sled conversion assembly attached to each end of the exercise device and fully assembled as it may be used to convert the exercise device of FIG. 1 into an exercise sled.
Figure 10:
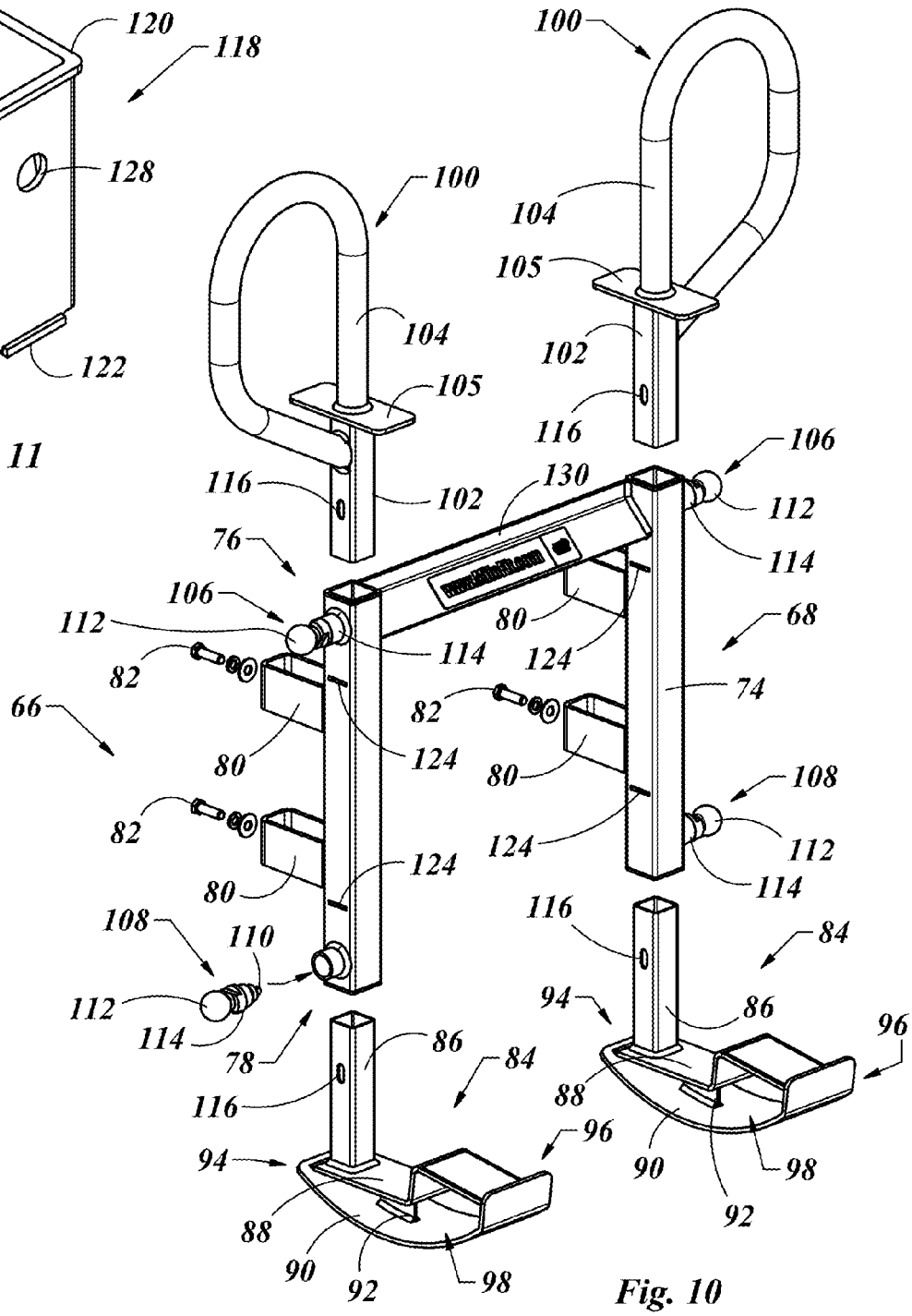
FIG. 10 is an isometric exploded view of a sled conversion assembly adapted for use with a functional exercise device as shown as it may be used in FIG. 9.

With reference to FIGS. 9 and 10, the device 20 is shown with a sled conversion assembly 66 attached to both the first end 26 and the second end 28 of the device 20. Each sled conversion assembly 66 may include a sled frame 68, which may be coupled to a mounting plate 70 on the end portion 30 of the exercise device 20. In FIG. 10 the sled conversion assembly 66 is shown in more detail, in a partially disassembled condition and removed from the exercise device 20. The sled frame 68 may be comprised of a first frame receiver 72 and a second frame receiver 74, positioned adjacent to and substantially parallel to the first frame receiver 72. The first frame receiver 72 may include a first end 76 any second end 78. A frame support 80 may be included on the first frame receiver 72 and the second frame receiver 74. The frame support 80 may be adapted to fasten the frame receivers (72 & 74) to the mounting plate 70 (FIG. 9) on the exercise device 20 with the mounting screws 82.

As is shown in FIG. 10, a sled skid 84 may include a sled extension 86, which may be releasably coupled to the first end 76, or the second end 78 of the first frame receiver 72 or the second frame receiver 74. The sled skid 84 may also include a skid base 88 mounted to the skid extension 86 and supporting a skid rail 90. A skid rib 92 may be coupled to the skid base 88 and the skid rail 90 at a position between a first end 94 the second end 96 of the skid base 88. As was shown in FIG. 9, the sled conversion assembly 66 may be used in conjunction with the exercise device 20.

In that the exercise device 20 may be used by flipping the device 20, the first end 26 flipped over the second end 28, or vice versa, it may be valuable that the sled skids 84 of the sled conversion assembly 66 be adapted to anticipate an inadvertent landing of the exercise device 20 on the sled skids 84. As previously noted, the bumpers 36 of the exercise device 20 may be adapted to dissipate the energy associated with the weight of the device 20 landing on the ground in a forceful manner after being flipped. The bumpers 36 may contact the ground directly. If the sled skids 84 are coupled to the sled frame 86 when the device 20 is flipped, it is possible that the sled skids 84 may make contact with the ground directly, and not the bumpers 36 as may be intended. Though the sled skid 84 may be positioned on top of the bumper 36 with the skid base 88 in direct contact with the bumper 36, a direct impact between the sled skid 84 and the ground may provide a high force to the sled frame 68 or the device 20. This high force caused by the sled skid 84 impacting with the ground could result in structural damage to the device 20. In an effort to prevent such damage to the device 20, in the event that someone inadvertently flipped the device 20 over onto the ground with sled skids 84 attached, the sled skids 84 may include a gap 98 between this skid base 88 and the skid rail 90. To add some structural support between the skid base 88 and the skid rail 90, the skid rib 92 may be provided in this gap 98.

The skid rib 90 may provide enough structural integrity so as to maintain the gap 98 between the skid base 88 and the skid rail 90 when loads are applied to the sled skid 84 under normal use, in other words, being supported on, but not being dropped on the sled skids 84. In the course of use, it may happen that a very high force is applied to the skid rail 90 of the sled skid 84, such as may be experienced if the sled skids 84 are attached to the exercise device 20, and the device 20 has been flipped over on the sled skids 84. If this happened, the sled skids 84 may contact the ground directly and not the bumper 36 of the exercise device 20. In this situation the skid rib 92 may act as a crumple zone to absorb the energy provided by the exercise device 20 being flipped onto the ground and landing on the sled skids 84. This energy may be absorbed by deforming the structure of the skid rib 92 and thereby decreasing the gap 98. This may result in making the sled skid 84 inoperable, but this relatively inexpensive and easily replaced item of the sled skid 84 may prevent any structural damage to the frame 22 of the device 20. By crushing the sled skid 84 and thereby deforming the skid rib 92, it may also alert the user that something is not right and they should cease the activity of flipping the exercise device 20 with the sled skids 84 attached.

It is also understood that a single frame receiver 72 may be used with a single sled skid 84 on the first end 26 and the second end 28 of the exercise deice 20. Though this is a viable alternative embodiment, it may be desired to have two frame receivers (72 and 74) and two sled skids 84, and as such is shown in these embodiments.

The sled conversion assembly 66 may also include a handle 100. The handle 100 may include handle extension 102 and a handlebar 104 mounted to the handle extension 102. The handle extension 102 may be similar or even identical to the sled extension 86, in that the function of each is to be received by a first and 76 or a second and 78 of the first frame receiver 72 or the second frame receiver 74. A handlebar 104 may be asymmetrical with regard to the handle extension 102. The asymmetry of the handlebar 104 of the handle 100 and may allow more than one position of the handlebar 104 relative to the sled frame 68 when the handle extension 102 is received by one of the frame receivers (72 and 74). This ability to provide alternate positions of the handles is illustrated in FIG. 9 in that the handles 100 near the first end 26 are positioned close to one another in contrast to the handles 100 positioned near the second end 28 are positioned wider. A handle plate 105 may be provided on the handle extension 102 in near the handlebar 104. The handle plate may contact the top of the bumper 36 of the exercise device 20 when the handle 100 is received by the frame receivers 72 and 74.

Releasably securing the sled skids 84 and the handles 100 to the frame receivers 72 and 74 of the sled frame 68, may be accomplished by providing a first lock 106 near the first end of the frame receivers 72 and 74, and a second lock 108 near the second end of the frame receivers 72 and 74. The first lock 106 and the second lock 108 may be identical in structure and function to one another, as is depicted here. The first lock 106 and the second lock 108 may each include a lock pin 110. The lock pin 110 may be actuated by pulling on the knob 112, which may compress a spring located within the lock housing 114. The spring may bias the lock pin 110 in a direction opposite to the knob 112 with respect to the lock housing 114. The lock pin 110 may then extend beyond the lock housing 114 and be received by the pin receiver 116 in the sled extension 86, and the handle extension 102. The pin receiver 116 may be comprised of an elongated slot as depicted in FIG. 10.

The elongated slot shape of the pin receiver 116 may have more than one advantage. One advantage may be the ability to receive the lock pin 110 within a dimension limited by the long dimension of the elongated slot shape of the pin receiver 116. This may allow for manufacturing tolerances as well as the fit of the sled skid 84 or the handle 100 as restricted by contact against the bumper 36 of the exercise device 20. In that the bumper 36 of the exercise device 20 is designed to allow for some deformation over time, it may be desirable to provide for some variation in the position relative to the ability to lock the sled skids 84 and handles 100 into the sled frame 68. This may be desirable due to some variation seen in the shape of the bumper 36 of the exercise device 20 in the manufacturing processes and any wear over time.

A second advantage to the elongated slot shape of the pin receiver 116 may be that some movement of the sled skid 84 within the sled frame 68 may be allowed in that the skid base 88 may be supported on the bumper 36, thereby allowing for some movement of the sled skid 84 relative to the sled frame 68. If the device 20 were to be dropped from a short distance onto the sled skids 84, the sled skids 84 may not deform as the force applied by the skid base 88 may be transferred to the top of the bumper 36 of the exercise device 20. Allowing some movement in the sled skids 84 or handles 100 may allow the bumper 36 to deform slightly, thus the bumper 36 may absorb the energy and not transmit that force directly into the sled frame 68.

Both the handle extension 102 of the handle 100 and sled extension 86 of the sled skid 84 may include a pin receiver 116 on both sides of the sled extension 86 and handle extension 102. Having a pin receiver 116 on both sides of the sled extensions 86 in handle extensions 102 may enable the sled skids 84 and the handles 100 to be received by the first frame receiver 72 or the second frame receiver 74 interchangeably, so as not to require a right sled skid and a left sled skid. In addition, the handles 100 may not only be received by the first frame receiver 72 or the second frame receiver 74, the handles 100 may also be rotated 180° to have the handle bars 104 facing out away from one another or in toward one another, thereby adding additional variability to the user.

Figure 11:
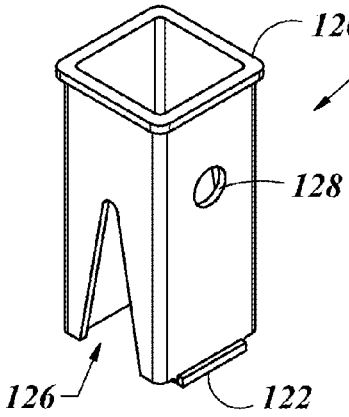
FIG. 11 is an isometric view of frame bushing which may be used in a frame receiver of a sled assembly.

It may be desirable to provide a controlled bearing surface between the outside of the handle extensions 102 and the sled extensions 86 with regard to the receivers 72 and 74 of the sled frame 68. The receivers 72 and 74 of the sled frame 68 may be manufactured from structural tubing. The manufacturing process of structural tubing may include a seam or flash where the ends of the flat sheet are welded together on the inside of the tube after being formed into the shape of the tube. The outside dimensions of the male element, in this case what may be the sled extensions 86 and the handle extensions 102, must be smaller than the inside dimension of the female structures, in this case the frame receivers 72 and 74 of the sled frame 68, so as to accommodate the height of the weld seam and allow the sled extensions 86 and handle extensions 102 to be received into the frame receivers 72 and 74. The added gap between the outer dimensions of the male structure in the inside dimensions of the female structure required due to normal manufacturing tolerances and exacerbated by the height of the weld seam may result in a sloppy fit between the mating parts. As such, it may be desirable to include a bushing 106 possibly manufactured of a pliable material, so as to allow for not only tolerance variations in the structural elements, but also accommodate the weld seam. Such a bushing 118, is shown in FIG. 11.

The bushing 118 may include a first flange 120, which may extend completely around the perimeter of one end of the bushing 118. The outer dimension of the first flange 120 may be greater than the inside dimension of the frame receivers 72 and 74. As such, the first flange 120 may act as a stop when the bushing 118 is inserted into the first end 76 or the second end 78 of the frame receivers 72 and 74. To secure the bushing 118 in the frame receiver 72 and 74 so that it does not pull out with the handle 100 or sled skid 84 when either is removed from the sled frame 68, a second flange 122 may be provided opposite to the first flange 120. The second flange 122 may be received by a slot 124 in the frame receivers 72 and 74. A cutout 126 may be provided in the flange 118 so as to allow the end of the bushing 118 supporting the second flange 122 to flex in, thus decreasing the overall dimension of the bushing 118 near the second flange 122 so that the bushing 118 may be inserted into the frame receiver 72 and 74. If the bushing 118 is manufactured of a pliable material such as a plastic, the bushing 118 may flex due to the reduced section modulus provided by the cutout 126 so that it may be inserted into the frame receivers 72 and 74. When inserted, the second flange 122 may be received by, and snap into the slot 124 in the frame receivers 72 and 74 of the sled frame 68, thereby securing the bushing 118 in place within the frame receivers 72 and 74. A hole 128 may be provided to allow access of the lock pin 110 to pass through to the pin receiver 116 of the sled skid 84.

As noted before, the sled frame 68 of FIG. 10 may be comprised of a single frame receiver (72 or 74). It is suggested that a preferred embodiment may be two frame receivers (72 and 74) as shown. With that, the sled frame 68 may be two separate structures, each with their frame supports 80, to mount to the mounting plate 70 of the exercise device 20. It may be desirable for the sled frame 68 to be one substantially rigid structure, which may include a crossbar 130 connecting the first frame receiver 72 to the second frame receiver 74. The crossbar 128 may be positioned closer to the first end 76 of the first frame receiver 72 or the second frame receiver 74 than it is to the second end 78 of the first frame receiver 72 or the second frame receiver 74. By positioning the crossbar 130 closer to one end of the sled frame 68, this may help make assembly onto the exercise device 20 easier as compared to the crossbar 130 being on both ends of the sled frame 68 or nearer to a midpoint of the sled frame 68, as there may be an interference due to the structure of the exercise device 20.

Figure 13:
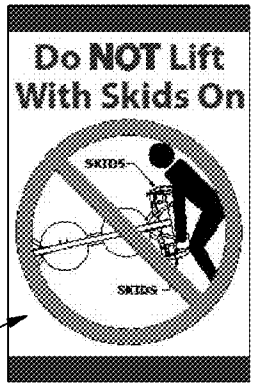
FIG. 13 is an example of a warning label as generally depicted in FIG. 13.
Figure 12:
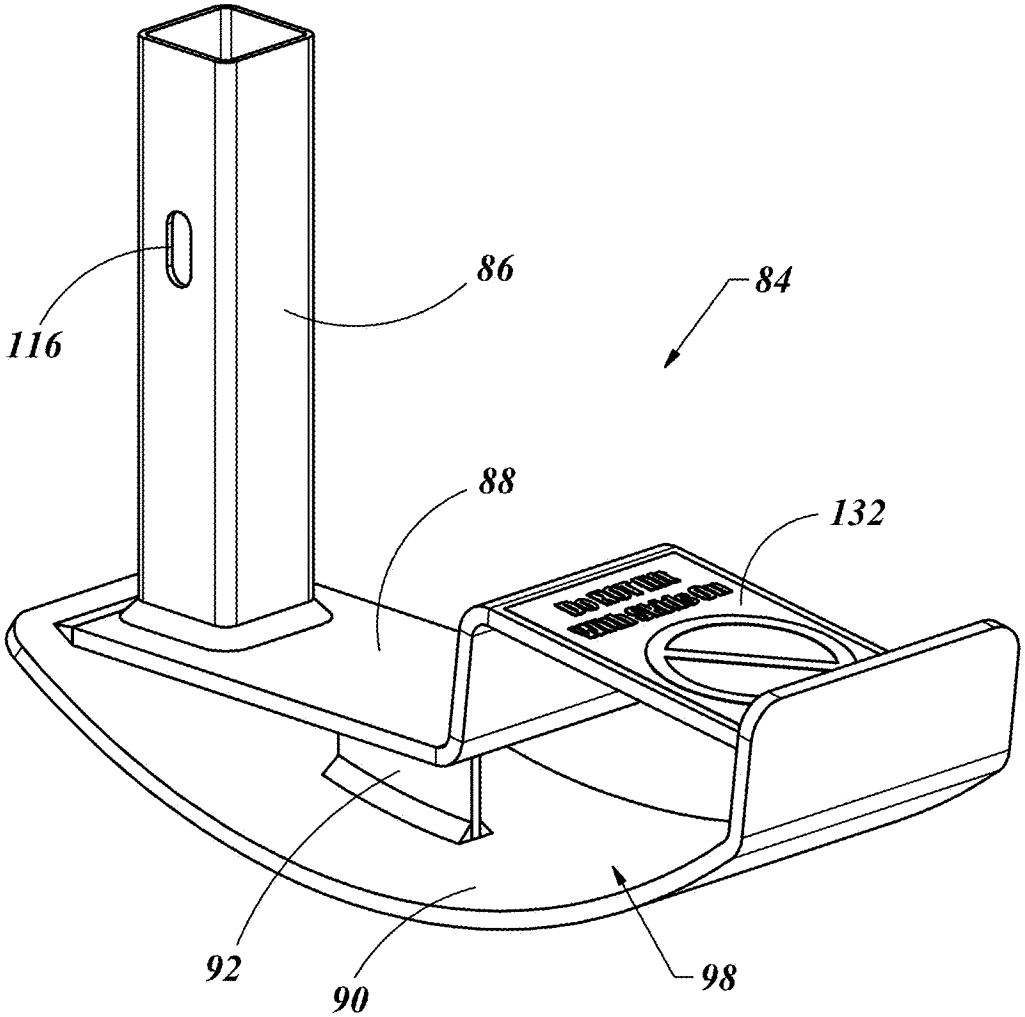
FIG. 12 is an isometric view of a sled skid of FIG. 10, shown with a simulated warning label.

With regard to FIGS. 12 and 13, the sled skid 84 is shown in more detail. In this embodiment, the sled skid 84 may include the skid base 88 supporting the sled extension 86 on one side and the skid rail 90 on the other side. In the gap 98, which may be provided between the skid base 88 and the skid rail 90, a skid rib 92 may be provided offering support to aid in maintaining the gap 98 between the skid base 88 and the skid rail 90. It has been disclosed earlier that one of the advantages to this embodiment of the sled skid 84 is a crush zone designed to absorb the impact if the exercise device 20 is mistakenly dropped onto the sled skids 84. This crush zone is shown with a gap 98 provided between the skid base 88, on which the bumper 36 of the exercise device 20 is supported, and the skid rail 90, which is supported on the ground. The skid rib 92 is intended to provide support between the skid base 88 and the skid rail 90, but only to a limited extent in that if a compression force is applied to the skid rib 92 above a determined threshold, then the skid rib 92 would intentionally deform and the dimension of the gap 98 would be reduced. The energy required to cause the skid rib 92 to fail, and in the process also deform the skid base 88 and/or the skid rail 90 would be absorbed by the sled skid 84 and not translated to the sled frame 68 or the frame 22 of the exercise device 20.

An additional measure to warn users not to lift the exercise device 20 with the sled skids 84 attached may be the addition of a warning label 132. The warning label 132 may be positioned on an upper extension of the skid base 88. The warning label 132 may include a graphic of a user lifting the exercise device 20 with the universal "do not" symbol of a circle with a line through it, as shown in FIG. 13. In addition, specific language may be used such as "Do NOT Lift With Skids On" to further alert a user that the exercise device 20 should not be lifted with the sled skids 84 attached to the exercise device 20 on the side that is being lifted. When the sled skids 84 are not present on the exercise device 20, the warning label 132 is also removed, as the warning is no longer applicable.

Figure 14:
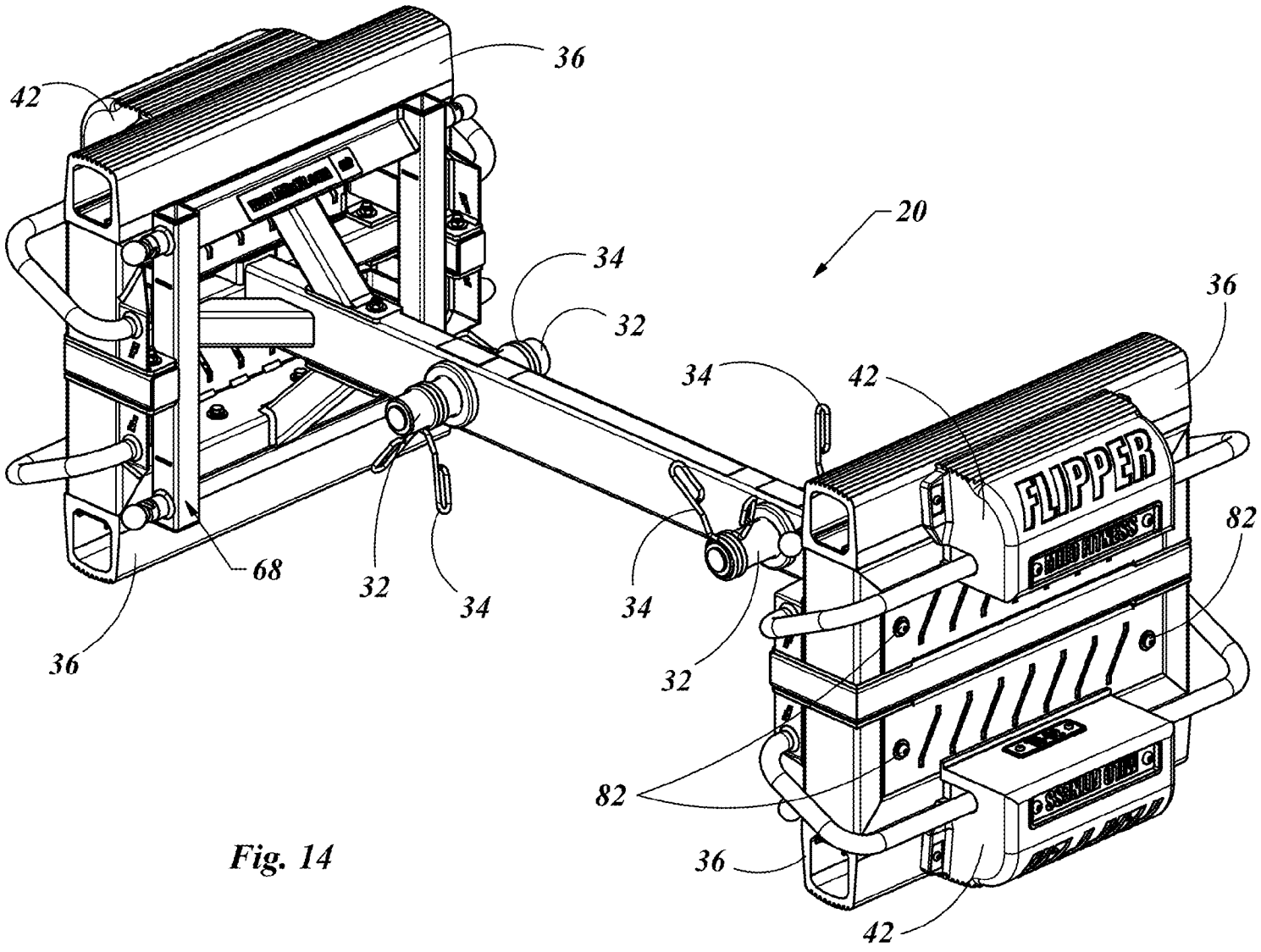
FIG. 14 is an isometric view of the exercise device of FIG. 1 with the sled frames of FIG. 10 attached thereto.
Figures 15, 16:
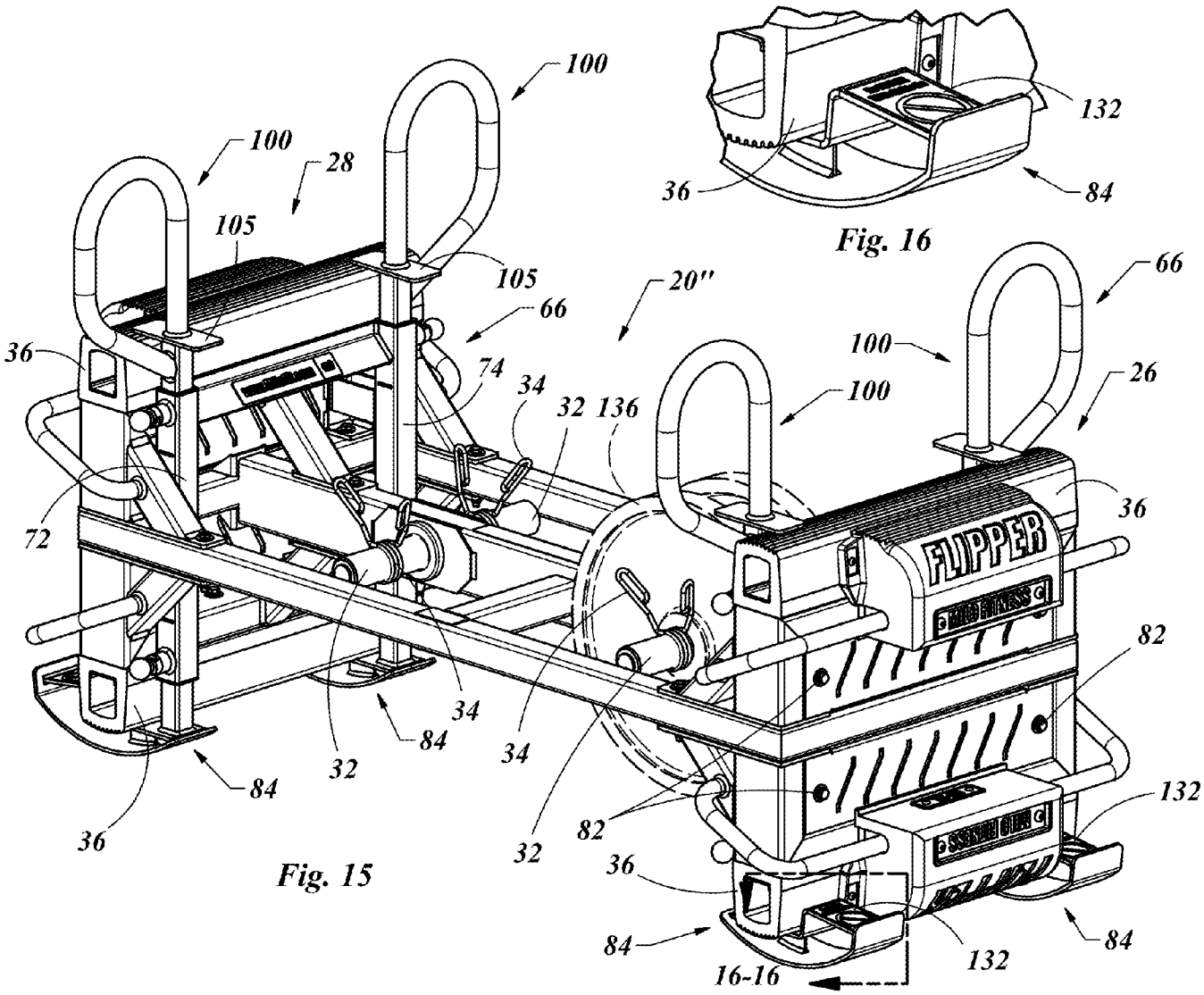
FIG. 15 is an isometric view of a variation to the exercise device of FIG. 1 with the sled conversion assembly of FIG. 10 attached to each end of the exercise device and fully assembled as it may be used, the sled skids having the warning labels as in FIG. 14.
FIG. 16 is a detailed view of a skid on the device of FIG. 15, shown along line 16-16.

An example of the exercise device 20 with the sled frames 68 attached to the exercise device 20 and the sled skids 84 are not attached is shown in FIG. 14. In this combination, the exercise device 20 may be flipped over without any potential damage to the sled skids 84, in that they are not present. In contrast, FIG. 15 shows an example of another embodiment of the exercise device 20" in which the sled conversion assemblies 66 are provided on both the first end 26 and the second end 28 of the exercise device 20". Here, in FIG. 15 is shown, the sled skid 84 located adjacent to the bottom bumpers 36 and handles 100 are positioned on the top of the exercise device 20" with the handle plates 105 of the handles 100 adjacent to the bumpers 36 on the top of the exercise device 20". Both the handles 100 and the sled skids 84 are received by the first frame receiver 72 and the second frame receiver 74. A pair of weight plates 136 is also shown being received by pins 32 and secured by the spring clips 34 as they may typically be used. The warning label 132 may also be seen by a user, as the user would typically approach the exercise device 20". This lifter is thereby being reminded that they should not lift that end of the exercise device 20" with the sled skids 84 attached. A detailed view of the sled skid 84 with the warning label 132 as it may be positioned on the exercise device 20" is shown in FIG. 16.

Figure 17:
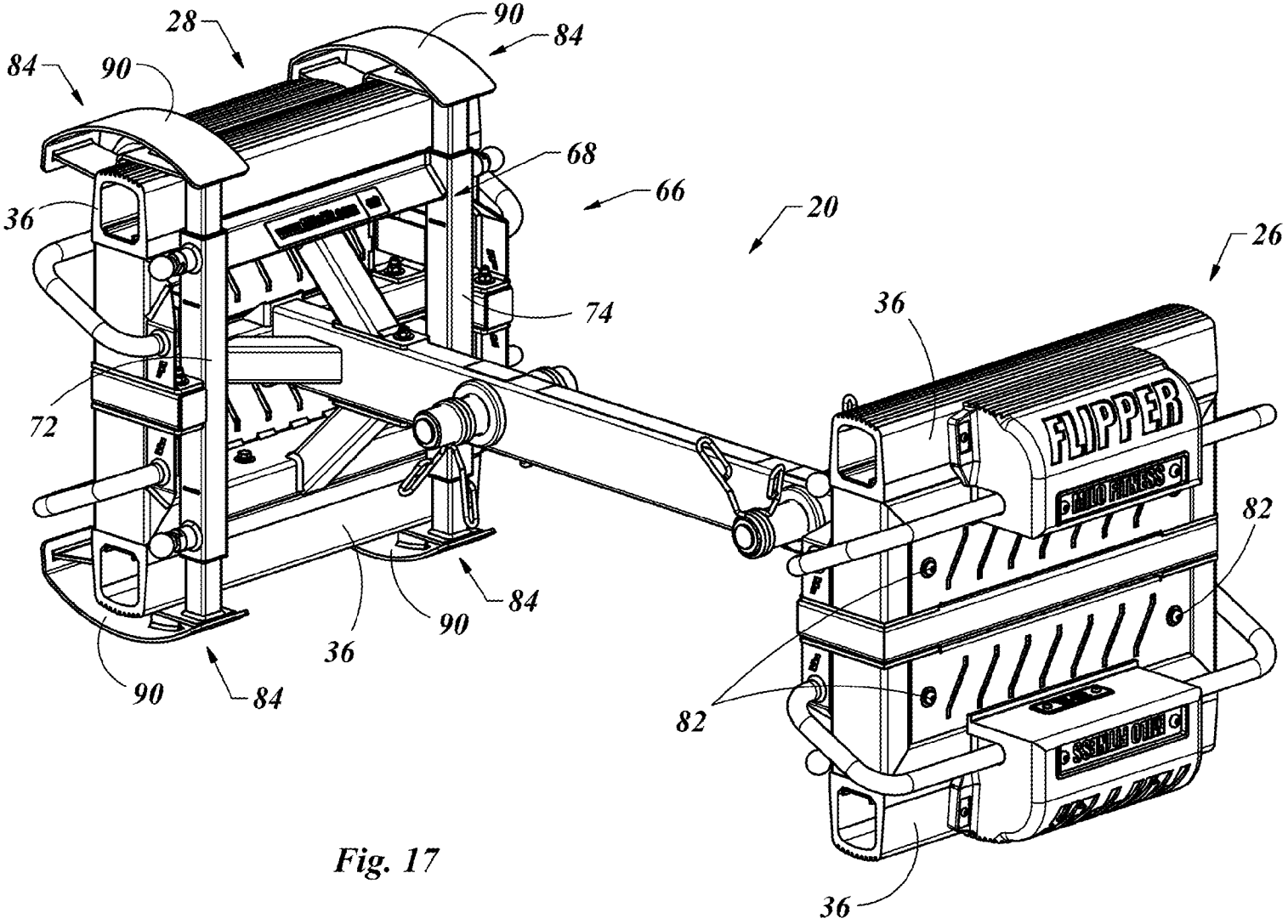
FIG. 17 is an isometric view of the exercise device of FIG. 1 with the sled frames of FIG. 10 attached to each end of the exercise device and an alternative sled assembly arrangement with sled skids on only one end of the exercise device.

With regard to FIG. 17, the exercise device 20 is shown with the sled frame 68 of the sled conversion assembly 66 mounted to the exercise device 20 on both the first end 26 and the second end 28 of the exercise device 20, by way of the mounting screws 82. On the second end 28 of the exercise device 20, the sled skids 84 are received by both ends of first frame receiver 72 and likewise on the second frame receiver 74. In this combination, there are no sled skids 84 coupled to the sled frame 68 at the first end 26 of the exercise device 20. In this arrangement, the first end 26 of the exercise device 20 may be lifted and driven forward, supported on the sled skids 84 on the bottom of the exercise device 20. After sliding the exercise device 20 forward on the sled skids 84 on the bottom, the exercise device 20 may be flipped over thereby being supported on the bumper 36 first shown on the top first end 26 of the exercise device 20 and the sled skids 84 first shown on the top of the second end 28 of the exercise device 20, in that after being flipped over, the exercise device 20 would be inverted. This is a wheelbarrow exercise. This wheelbarrow exercise may be performed in that the first end 26 of the exercise device 20, which is lifted, does not include any sled skids 84.

The absence of the sled skids 84 on the first end 26 of the exercise device 20, makes it acceptable to lift the first end 26 of the exercise device 20. This is reiterated by the fact that the warning labels 132 warning the lifter not to lift that end of the exercise device 20 are not present on that end of the exercise device 20, because there are no sled skids 84 immediately visible to the lifter at the first end 26 of the exercise device 20.

In the wheelbarrow configuration, the exercise device 20 with this combination of the sled skid assembly 66, it may be desirable to have the skid rail 90 include an arcuate portion. The arcuate portion shape of the skid rail 90 may allow the exercise device 20 with the sled conversion assembly 66 in this configuration to be flipped over as described with the sled skids 84 on the opposite end (second end 28 shown here) to more easily transition through being flipped over as it may "roll" on the arcuate portion of the skid rail 90 while being flipped over.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. A flipping exercise device, comprising:

a frame including a longitudinal center section, defining a first end and a second end and two substantially equal end sections, one of each of the substantially equal end sections coupled to the first end and the second end of the center section substantially at a midpoint with respect to a width and a height of each of the substantially equal end sections;

a pin coupled to and extending horizontally from the center section between the first end and the second end, the pin adapted to receive a weight plate; and a bumper directly fastened to a top surface and a bottom surface of each of the substantially equal end sections, whereby the exercise device is configured to rest only on two bumpers, each fastened to the bottom surface of each of the substantially equal end sections, or flipped over to rest only on two other bumpers, each fastened to the top surface of each of the substantially equal end sections.

2. The exercise device according to claim 1, wherein the bumper is a substantially longitudinal member with a hollow cavity.

3. The exercise device according to claim 2, further comprising a bumper plate which is inserted into the hollow cavity of the substantially longitudinal member, the bumper plate including fasteners enabling fastening if the bumper to each of the substantially equal end sections.

4. The exercise device according to claim 3, wherein the bumper plate is substantially longitudinal and includes a flange along a long side of the bumper plate.

5. The exercise device according to claim 3, wherein the bumper plate is substantially longitudinal and includes a flange along both long sides of the bumper plate.

6. The exercise device according to claim 1, further comprising a chest support coupled to each of the two substantially equal end sections of the frame.

7. The exercise device according to claim 6, wherein each of the chest supports is also directly coupled to one of the bumpers on each of the two substantially equal end sections of the frame.

8. The exercise device according to claim 1, wherein the frame is substantially symmetrical about three orthogonal planes intersecting at a geometric center of the frame.

9. The exercise device according to claim 1, further comprising a handle coupled to each of the two substantially equal end sections of the frame.

* * * * *